United States Patent [19]

Ross et al.

[11] Patent Number: 4,946,656

[45] Date of Patent: Aug. 7, 1990

[54] VENTED STRIPPER SECTION FOR A FLUID CATALYTIC CRACKING UNIT APPARATUS

[75] Inventors: Mark S. Ross, Lawrenceville; John C. Zahner, Princeton, both of N.J.

[73] Assignee: Mobil Oil Corporation, New York, N.Y.

[21] Appl. No.: 137,116

[22] Filed: Dec. 22, 1987

[51] Int. Cl.[5] ..... F27B 15/02; F27B 15/09

[52] U.S. Cl. ..... 422/144; 422/145; 422/147; 422/310

[58] Field of Search ..... 422/139, 143, 144, 145, 422/147, 310, 311

[56] References Cited

U.S. PATENT DOCUMENTS

| | | | |
|---|---|---|---|
| 2,838,063 | 6/1958 | Weits et al. | 137/382 |
| 2,886,419 | 5/1959 | Orr et al. | 422/144 |
| 2,934,494 | 4/1960 | Kleiber | 208/161 |
| 3,784,360 | 1/1974 | Bunn et al. | 422/144 X |
| 3,821,103 | 6/1974 | Owen et al. | 208/153 |
| 4,219,407 | 8/1980 | Haddad et al. | 208/151 |
| 4,404,095 | 9/1983 | Haddad et al. | 208/161 |
| 4,446,107 | 5/1984 | Buyan et al. | 208/107 |
| 4,464,250 | 8/1984 | Myers et al. | 422/120 |
| 4,502,947 | 3/1985 | Haddad et al. | 208/161 |
| 4,572,780 | 2/1986 | Owen et al. | 208/161 |
| 4,588,558 | 5/1986 | Kam et al. | 422/147 X |

*Primary Examiner*—Barry S. Richman
*Assistant Examiner*—Amalia L. Santiago
*Attorney, Agent, or Firm*—Alexander J. McKillop; Charles J. Speciale; Malcolm D. Keen

[57] ABSTRACT

Disclosed is a process and apparatus for fluid catalytic cracking (FCC). Output of an FCC riser feeds a riser cyclone. A downstream end of the riser and the riser cyclone are located within a reactor vessel (disengaging vessel) having sidewalls. Cracked hydrocarbons in the output pass from the riser into a riser cyclone and discharge from the reactor vessel without being added to a reactor vessel atmosphere. A stripper cap divides the reactor vessel atmosphere into upper and lower portions. The stripper cap and a lower portion of the reactor vessel sidewalls define a stripping zone. A riser cyclone dipleg extends through an opening in the stripper cap into the stripping zone. A chimney vent conduit is provided for conducting stripped hydrocarbons out of the stripping zone without being added to the atmosphere of the reactor vessel above the stripper cap.

11 Claims, 1 Drawing Sheet

FIG. 1
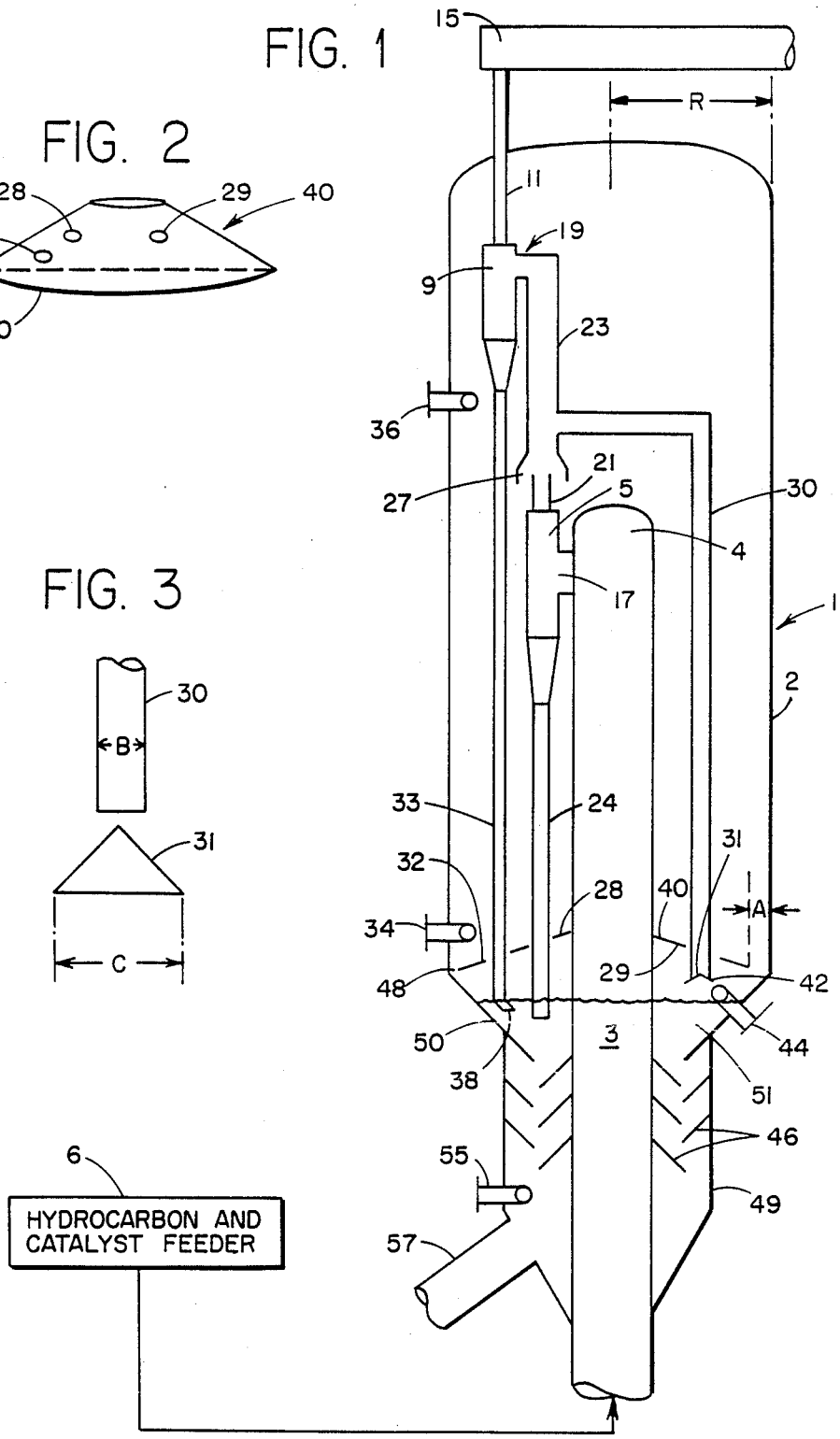
FIG. 2
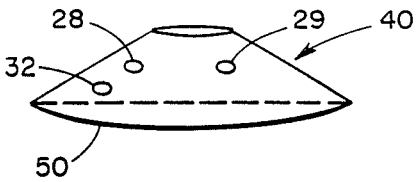
FIG. 3

VENTED STRIPPER SECTION FOR A FLUID CATALYTIC CRACKING UNIT APPARATUS

BACKGROUND OF THE INVENTION

1. Field of the Invention

The present invention relates to a process and apparatus for a fluid catalytic cracking (FCC) unit. More particularly, the present invention relates to a process and apparatus for reducing residence time of stripped hydrocarbon vapors within an FCC reactor vessel (disengaging vessel) by employing a vented stripper section.

2. Discussion of the Prior Art

By way of background, the hydrocarbon conversion catalyst usually employed in a FCC installation is preferably a high activity crystalline zeolite catalyst of a fluidizable particle size. The catalyst is transferred in suspended or dispersed phase condition with a hydrocarbon feed generally upwardly through one or more riser conversion zones (FCC cracking zones) providing a hydrocarbon residence time in each conversion zone in the range of 0.5 to about 10 seconds and usually less than about 8 seconds. High temperature riser hydrocarbon conversions, occurring at temperatures of at least 980° F. and a 0.5 to 4 seconds hydrocarbon residence time in contact with the catalyst in the riser, are desirable for some operations before initiating separation of vaporous hydrocarbon product materials from the catalysts.

Rapid separation of catalyst from hydrocarbons discharged from a riser conversion zone is particularly desirable for restricting hydrocarbon conversion time. During the hydrocarbon conversion, carbonaceous deposits accumulate on the catalyst particles and the particles entrain hydrocarbon vapors upon removal from the hydrocarbon conversion zone. The entrained hydrocarbons are subjected to further contact with the catalyst until they are removed from the catalyst by a separator, such as cyclonic equipment, or stripping gas in a separate catalyst stripping zone or both. Hydrocarbon conversion products separated and stripped from the catalyst are combined and typically passed to a product fractionation step. Stripped catalyst containing deactivating amounts of carbonaceous material, hereinafter referred to as coke, is then passed to a catalyst regeneration operation.

Of particular interest has been the development of methods and systems for efficiently separating catalyst particles from a gasiform mixture of catalyst particles and vaporous hydrocarbon product which is discharged from the riser. Such separation reduces overcracking of hydrocarbon conversion products and promotes the recovery of desired products of a hydrocarbon conversion operation.

Various process and mechanical means have been employed heretofore to effect rapid separation of the catalyst phase from the hydrocarbon phase, at the termination of the riser conversion zone, to minimize contact time of the catalyst with cracked hydrocarbons.

U.S Pat. No 4,502,947 to Haddad et al discloses a closed cyclone fluid catalytic cracking catalyst separation method and apparatus. In the closed cyclone method and apparatus, hydrocarbon product from a riser is separated from catalyst and discharged from a disengaging vessel (reactor vessel) without substantially passing into an atmosphere of the disengaging vessel. Preventing passage of the hydrocarbon into the atmosphere of the disengaging vessel reduces the time for overcracking the hydrocarbon product by high temperature thermal cracking and overly long contact with catalyst.

U.S. Pat. No. 4,572,780 to Owen et al discloses a method and apparatus for fluid catalytic cracking of a hydrocarbon feed and is incorporated herein by reference. The method and apparatus includes a multistage stripper system. The multistage stripper system comprises a means for spinning a gasiform mixture of catalyst and cracked hydrocarbons exiting from a riser, a first means for stripping the spun gasiform mixture, and a means for deflecting the gasiform mixture to separate catalyst from the cracked hydrocarbons. A downstream end of a riser conversion zone may terminate within a stripper vessel located within a disengaging vessel (reactor vessel).

A need exists for developing new systems, for decreasing residence time of hydrocarbon vapor products stripped away from catalyst in a fluid catalytic cracking reactor vessel. Particularly a need exists for systems useful in modifying existing designs. Short residence times for stripped hydrocarbon vapor is especially valuable as the technology progresses to employing higher reaction temperatures and heavier feedstocks.

SUMMARY OF THE INVENTION

It is an object of the present invention to provide a process and apparatus to reduce residence time of hydrocarbon conversion products in a fluid catalytic cracking reactor vessel.

It is a further object of the present invention to provide a process and apparatus to reduce the residence time of stripped hydrocarbon vapors exiting a stripping zone of a fluid catalytic cracking reactor vessel.

It is a further object of the present invention to provide a process and apparatus to reduce overcracking of hydrocarbon vapors and reduce coke build-up within the fluid catalytic cracking reactor vessel.

In its process aspects, the present invention achieves the foregoing objects by a fluid catalytic cracking process performed in a closed cyclone system, an example of which is disclosed by U.S. Pat. No. 4,502,947 to Haddad et al. In the present process, a suspension of hydrocarbon feed and catalyst passes through a riser at fluid catalytic cracking conditions. The riser terminates within a reactor vessel (disengaging vessel). The mixture then discharges from the riser and passes into a riser cyclone which is part of the closed cyclone system. Catalyst is separated from the suspension in the riser cyclone and passes through a riser cyclone dipleg. The riser cyclone dipleg and dipleg of any other cyclones provided in the closed cyclone system, extend downwardly into a dense catalyst bed portion of a stripping zone through holes in a stripper cap. The stripping zone is defined by the stripper cap and sidewalls of a lower portion of the reactor vessel. The stripper cap is an annular conical ring, attached to the riser, which extends outwardly from the riser to adjacent the reactor vessel sidewalls. An annulus is formed between the cap and reactor vessel sidewalls. The stripper cap slopes downwardly, from where it is attached to the riser, to allow catalyst in the portion of the reactor vessel above the stripper cap to drain back into the stripping zone. Preferably, the stripper cap is a frustoconical ring. Hydrocarbons stripped from the catalyst in the stripping zone flow upwardly through a chimney vent conduit and exit the reactor vessel without being added to an atmosphere of the reactor vessel above the stripper cap. The chimney vent conduit extends through a hole in the stripper cap and preferably is also in communication with an inlet conduit to a primary cyclone provided downstream of the riser cyclone. Preferably, the reactor vessel atmosphere above the stripper cap and the portion of the reactor vessel atmosphere below the stripper cap, between the stripper cap and the catalyst bed located within the stripper zone, are purged with steam.

In its apparatus aspects, the invention comprises a reactor vessel (disengaging vessel) which houses an elongated tubular riser conduit having a downstream end which terminates in the reactor vessel, means for feeding a suspension of hydrocarbon and catalyst into the riser to produce a mixture of catalyst and cracked hydrocarbons, which exits from the downstream end of the riser, a closed cyclone system preferably comprising a riser (first) cyclone connected to the downstream end of the riser by a first enclosed conduit, a primary (second) cyclone connected to an outlet of the riser cyclone by a second conduit, and a stripper cap. The first and second conduits prevent addition of the suspension passing therethrough to the atmosphere of the reactor vessel. The stripper cap is an annular ring attached to the riser, extends outwardly to adjacent the reactor sidewalls to form an annulus therebetween, and slopes downwardly from the riser. The riser cyclone and primary cyclone diplegs extend downwardly through holes in the stripper cap and terminate within a stripping zone defined by a lower portion of the reactor vessel sidewalls and the stripper cap. Means for discharging stripped hydrocarbons from the reactor vessel without adding them to the reactor vessel atmosphere above the stripper cap are provided which preferably include a chimney vent conduit. An upstream end of the chimney vent conduit extends downwardly through an opening in the stripper cap into the stripping zone. A downstream end of the chimney vent conduit is attached to, and communicates with, the closed cyclone system. Most preferably the chimney vent conduit is attached to, and in communication with, a primary cyclone inlet conduit. Preferably the stripper cap is a frustoconical ring.

The invention in both its process and apparatus aspects, can be configured as an original installation, or as a retrofit to an existing fluid catalytic cracking reactor system. It has the advantage that it reduces the residence time of stripped hydrocarbons in the reactor vessel by providing the stripper cap and chimney vent conduit. The stripper cap and chimney vent conduit reduce the volume through which stripped hydrocarbons need pass. Without the stripper cap and chimney vent conduit, the stripped hydrocarbons would pass through the entire reactor vessel atmosphere to result in longer residence time.

BRIEF DESCRIPTION OF THE DRAWINGS

FIG. 1 is a schematic representation of a side view of a fluid catalytic cracking (FCC) reactor system of an embodiment of the present invention;

FIG. 2 is a perspective view of the stripper cap of the present invention; and

FIG. 3 is an enlarged view of a portion of FIG. 1.

DETAILED DESCRIPTION OF THE INVENTION

As well known, the fluid catalytic cracking (FCC) process employs a catalyst in the form of very fine particles which act as a fluid when aerated with a vapor. The fluidized catalyst is circulated continuously between a reaction zone and a regeneration zone and acts as a vehicle to transfer heat from the regeneration zone to the hydrocarbon feed and reaction zone. The FCC process is valuable to convert heavy hydrocarbon into more valuable gasoline and lighter products.

The invention will now be described in greater detail in connection with the specific embodiment thereof illustrated by FIGS. 1–3. This embodiment, however, is not to be construed as a limitation on the scope of the invention, but is merely provided by way of exemplary illustration.

As shown in FIG. 1, the present invention employs a reactor vessel 1 having sidewalls 2 and an elongated tubular riser 3 which defines a riser conversion zone. Riser 3 has a downstream end 4 which terminates within the reactor vessel 1. Hydrocarbon and catalyst from a hydrocarbon and catalyst feeder 6 pass together as a commingled mixture through the riser 3 at fluid catalytic cracking conditions. Except for makeup catalyst, the catalyst provided by feeder 6 is regenerated catalyst typically at a temperature of at least 1200° F. (649° C.), preferably 1250°–1350° F. (677°–732° C.), so that the commingled mixture has a temperature of at least 980° F. (527° C.) in the riser 3. The fluid catalytic cracking conditions cause the hydrocarbon feed to crack when contacted with the catalyst thus forming a suspension of cracked hydrocarbon vapor and catalyst particles. The suspension of cracked hydrocarbon vapor and catalyst particles discharges from riser 3 and enters a riser cyclone 5 by a conduit 17. Conduit 17 is attached to both the riser 3 and riser cyclone 5 and in communication with both riser 3 and riser cyclone 5. Riser cyclone 5 separates a portion of the catalyst from the suspension and sends the separated catalyst through a riser cyclone dipleg 24 to a catalyst stripping zone 49 provided in a lower portion of the reactor vessel 1.

The present invention employs a closed cyclone process and apparatus. The closed cyclone system quickly separates the catalyst from the hydrocarbons and discharges the hydrocarbons from the reactor vessel through conduit 11 before the hydrocarbons have time to overcrack.

The downstream end 4 of the riser 3 is attached to the riser cyclone 5, the primary cyclone 9, and an optional secondary cyclone (not shown) in series. The riser cyclone 5 is attached to the riser 3 by means of a riser cyclone inlet conduit 17. Conduit 17 prevents adding the suspension of cracked hydrocarbons and catalyst passing therethrough to the atmosphere of the reactor vessel. The riser cyclone 5 in turn is connected to the primary cyclone 9 by means of a riser cyclone overhead conduit 19. Overhead gas from the primary cyclone 9 or secondary cyclone (not shown) exits the reactor vessel 1 by means of an overhead conduit 11 and discharges into a reactor overhead port 15. Overhead port 15 passes the discharged gases to downstream processing such as distillation.

The riser cyclone overhead conduit 19 provides a passageway for catalysts and cracked hydrocarbons to travel from the riser cyclone 5 to the primary cyclone 9 without being added to the reactor vessel 1 atmosphere.

However, preferably an annular port 27 is provided to admit stripping gas from the atmosphere of reactor vessel 1 into the conduit 19 to aid in separating catalyst from hydrocarbons adhering thereto. As illustrated by FIG. 1, the conduit 19 comprises 2 parts, a gas extension tube 21 and an inlet duct 23 of the primary cyclone 9. The inlet duct 23 is of greater diameter then the gas extension tube 21. As a consequence, the annular port 27 is formed when the ends of the gas extension tube 21 and inlet duct 23 overlap. Although the annular port 27 could be located in a horizontal portion of conduit 19, preferably it is located in a vertical portion of conduit 19 as shown by FIG. 1. The annular port 27 should be dimensioned to have an area which allows gas from the atmosphere of the reactor vessel to pass through the annular port at a velocity between 5 and 100 feet per second.

The principal purposes of conduits 17, 19 and 11 is to provide a direct passage of the cracked hydrocarbons from the riser 3 to, and through, the riser cyclone 5 and the primary cyclone 9. This limits the time the cracked hydrocarbons are exposed to elevated cracking temperatures. Otherwise, the cracked hydrocarbons would randomly pass through the upper portion of the reactor vessel 1 to the cyclone separators to provide additional opportunity for non-selective thermal cracking of the hydrocarbons and catalytic cracking, thus lowering the product yield.

To maintain the seal required for a closed cyclone system, because the pressure in the riser cyclone 5 is higher than that of the reactor vessel 1, a means for sealing is provided for an opening at a bottom of the riser cyclone dipleg 24. As shown in FIG. 1, riser cyclone dipleg 24 may be sealed by immersing it in a dense phase catalyst bed 51 located in the lower portion of the reactor vessel 1. Other means for sealing such as a seal pot, as illustrated by U.S. Pat. No. 4,502,947, or a trickle valve, as illustrated by U.S. Pat. No. 2,838,063, may also be employed. Primary cyclone 9 preferably is also sealed by immersing it in catalyst bed 51, or by a trickle valve 38 as shown by FIG. 1, or other suitable sealing means.

Catalyst particles separated from the suspension of hydrocarbon vapor and catalyst particles by the cyclones 5, 9 drop through diplegs 24, 33 respectively and feed the reactor stripping zone 49. It will be apparent to those skilled in the art that although only one series connection of cyclones 5, 9 are shown in the embodiment of FIG. 1, more than one series connection and/or more or less than two consecutive cyclones in series connection could be used.

The stripping zone 49 is defined by the sidewalls 2 of a lower portion of the reactor vessel 1 and by a downwardly slanted, frustoconical stripper cap 40, and contains the dense phase catalyst bed 51. Stripper cap 40 is attached to the riser 3 and extends outwardly to adjacent the reactor vessel sidewalls 2. An annulus 48 is defined between the circumference 50 (shown by FIG. 2) of stripper cap 40 and the sidewalls 2 of the reactor vessel 1. Preferably the circumference 50 is spaced from the reactor vessel sidewalls 2 by a distance "A" which is at most about 25% of the inside radius "R" of the reactor vessel 1. Catalyst may entrain into the reactor vessel 1 atmosphere above the stripper cap 40 due to catalyst surges during non-steady state operation through gas extension tube 21 that discharge through annulus 27, and/or a minor portion of catalyst that may elutriate out of the stripping zone 49. The stripper cap 40 slopes downwardly away from the riser connection to allow the catalyst which may be entrained in the reactor vessel 1 atmosphere above the stripper cap 40, to drain back into the stripping zone 49 through the annulus 48. The cyclone diplegs 24, 33 extend down into the dense bed portion 51 of the stripping zone through holes 28, 32, respectively, in the stripper cap 40.

In stripping zone 49, the catalyst in dense bed 51 is contacted with a stream of stripping gas provided by a stripping gas header 55. The stripping gas flows counter currently to the catalyst. The stripping gas is preferably steam but may be other gases such as light hydrocarbons (hydrocarbons having molecular weights of at most that of butane). Stripped catalyst is removed by a conduit 57 for passage to either a catalyst regeneration zone (not shown) or to a second stage hydrocarbon conversion zone (not shown), depending on activity and the amount of carbonaceous material, e.g., coke, deposited on the catalyst particles.

The stripping zone 49 may also be provided with trays 46. Trays 46 are optionally perforated.

Stripped hydrocarbons discharge from the stripping zone 49 by passing through a chimney vent conduit 30. Chimney vent conduit 30 extends from a portion of the atmosphere of the reactor vessel 1, which is defined between the catalyst bed 51 and the stripper cap 40, up through an opening 29 of stripper cap 40.

The stripped hydrocarbons then pass through chimney vent conduit 30 and discharge from the reactor vessel 1 without being added to the portion of the reactor vessel atmosphere above the stripper cap 40. This is accomplished by either discharging the stripped hydrocarbons from the conduit 30 directly to outside of the reactor vessel 1 or preferably by attaching the conduit 30 to the conduit 19, which connects the riser cyclone 5 and primary cyclone 9, to be in communication with conduit 19. Most preferably, chimney vent conduit 30 is attached to, and in communication with, the conduit 23 portion of conduit 19 downstream of where conduit 23 and gas extension tube 21 overlap. Thus, as shown by FIG. 1, the stripped hydrocarbons flow upwardly through the chimney vent conduit 30 and exit the reactor vessel 1 through the primary cyclone 9 and conduit 11. The diplegs 24, 33 and chimney vent conduit 30 are preferably not attached to the stripper cap 40 but rather the openings 28, 32, and 29 respectively for diplegs 24, 33, and chimney vent 30 are sufficiently sized so that the diplegs 24, 33 and chimney vent 30 do not touch the stripper cap 40. This allows for differences in thermal expansion.

Preferably, the atmosphere of the reactor vessel 1 above the stripper cap 40 is purged with steam providing by steam spargers 34, 36. Furthermore, the atmosphere of the stripping zone 49 provided between the stripper cap 40 and the catalyst bed 51 is purged with steam from a steam sparger 44 which discharges steam directly into the atmosphere (free space) above the catalyst bed 51. Furthermore, a conical baffle 31 is provided so that stripped hydrocarbons pass into a space between the conical baffle 31 and an opening at the bottom of the chimney vent conduit 30. The conical baffle 31 and chimney vent conduit 30 bottom opening are adjacent and axially aligned. Also the conical baffle 31 has a diameter "C" which is larger than a diameter "B" of the bottom opening of the chimney vent conduit 30 as shown by FIG. 3.

The present invention has many advantages. The stripper cap is simple and sturdy and can be easily installed in existing units with minimal modifications. The stripper cap, when employed with a chimney vent conduit and closed cyclone system, reduces the residence time, in the FCC reactor vessel, of the hydrocarbon vapors exiting the stripper. This reduces overcracking of these vapors and reduces coke buildup within the reactor vessel.

While specific embodiments of the process and apparatus aspects of the invention have been shown and described, it should be apparent that many modifications can be made thereto without departing from the spirit and scope of the invention. Accordingly, the invention is not limited by the foregoing description, but is only limited by the scope of the claims appended hereto.

We claim:

1. A fluid catalytic cracking apparatus comprising:
(a) a reactor vessel comprising sidewalls;
(b) an elongated tubular fluid catalytic cracking riser having a downstream end which terminates within said reactor vessel;
(c) a downwardly sloped stripper cap attached to said riser and located within said reactor vessel and downwardly extending away from said riser to adjacent said reactor vessel sidewalls and having a first opening and a second opening;
(d) means for stripping catalyst defined by a lower portion of said reactor vessel below said stripper cap;
(e) first means for injecting stripping gas into a lower portion of said stripping means;
(f) a riser cyclone having a dipleg and being located within said reactor vessel, said riser cyclone dipleg extending downwardly from said riser cyclone through said stripper cap first opening into said stripping means;
(g) means for passing a gaseous effluent from said riser to outside said reactor vessel, without adding said gaseous effluent to a reactor vessel atmosphere during steady state conditions, comprising a riser cyclone inlet conduit attached to said riser and attached to said said riser cyclone, said inlet conduit being in communication with said riser and said riser cyclone;
(h) means for passing stripped hydrocarbons from said stripping means to outside said reactor vessel without adding said stripped hydrocarbons to said reactor vessel atmosphere above said stripper cap; and
(i) means for discharging catalyst from said stripping means to outside said reaction vessel.

2. The apparatus of claim 1, wherein said stripper cap is frustoconical, has a circumference, and defines an annulus between said circumference and said reactor vessel sidewalls.

3. The apparatus of claim 2, wherein said means for passing stripped hydrocarbons comprises a chimney vent conduit attached to said means for passing gaseous effluent from said riser to outside said reactor vessel, said chimney vent conduit extending downwardly from said means for passing gaseous effluent, through said second opening of said cap and being in communication with said means for passing gaseous effluent and said means for stripping.

4. The apparatus of claim 3, wherein said reactor vessel has an upper portion above said stripper cap, and wherein said annulus is defined by spacing said stripper cap circumference from said reactor vessel sidewalls by a distance of at most about 25% of an inside radius of said upper portion of said reactor vessel.

5. The apparatus of claim 4, wherein said reactor vessel further comprises means for injecting steam into said reactor vessel above said stripper cap.

6. The apparatus of claim 5, further comprising trays vertically spaced within said stripping zone and additional means for injecting steam into a zone within said reactor vessel between said stripper cap and said trays.

7. The apparatus of claim 6, further comprising a conical baffle located adjacent and below a bottom opening of said chimney vent, said conical baffle having a larger diameter than said chimney vent conduit.

8. The apparatus of claim 7, wherein said means for passing gaseous effluent from said riser cyclone to outside said reactor vessel comprises a second conduit attached to said riser cyclone which has a second conduit port for passing gas from an atmosphere of said reactor vessel upper portion into said second conduit.

9. The apparatus of claim 8, wherein said second conduit port is an annular port and said second conduit comprises a gas extension tube, attached to said riser cyclone, and a primary cyclone inlet duct, said gas extension tube being inserted into said inlet duct to overlap it and thereby form said annular port therebetween, and wherein said chimney vent communicates with a portion of said primary cyclone inlet duct which does not overlap said gas extension tube, wherein said means for passing gaseous effluent from said riser cyclone further comprises a primary cyclone attached to said second conduit, said primary cyclone having a dipleg and being located within said reactor vessel, said stripper cap having a third opening, said primary cyclone dipleg extending through said stripper cap third opening into said stripping zone.

10. The apparatus of claim 9, further comprising means for sealing said riser cyclone dipleg and said primary cyclone dipleg.

11. An apparatus for fluid catalytic cracking of a hydrocarbon feed comprising:
(a) a reactor vessel comprising sidewalls;
(b) an elongated tubular fluid catalytic cracking riser having an upstream end and a downstream end, said downstream end terminating within said reactor vessel;
(c) a frustoconical, downwardly sloped stripper cap located within said reactor vessel and extending from said riser towards said reactor vessel sidewalls to define an annulus between the circumference of said cap and said reactor vessel sidewalls, said annulus spacing said cap circumference from said sidewalls by a distance of at most about 25% of an inside radius of an upper portion of said reactor vessel about said stripper cap, said stripper cap having a first opening, a second opening and a third opening;
(d) means for stripping catalyst defined by a lower portion of said reactor vessel below said stripper cap, said stripping means comprising first means for injecting stripping gas into a lower portion of said stripping means, trays vertically spaced within said stripping means;
(e) second means for injecting steam into said stripping means between said trays and said stripper cap;

(f) third means for injecting steam into said reactor vessel above said stripper cap;

(g) a riser cyclone having a dipleg and being located within said reactor vessel, said riser cyclone dipleg extending downwardly from said riser cyclone through said stripper cap first opening into said stripping means;

(h) means for passing a gasiform effluent from said riser to outside said reactor vessel, without adding said gasiform effluent to a reactor vessel atmosphere under steady state conditions, comprising a riser cyclone inlet conduit attached to said riser and attached to said riser cyclone, said inlet conduit being in communication with said riser and said riser cyclone, a gas extension tube, a primary cyclone inlet duct, and a primary cyclone having a dipleg, said gas extension tube being attached to said riser cyclone and inserted into said primary cyclone inlet duct to overlap it and thereby form an annular port therebetween, said inlet duct being attached to an inlet of said primary cyclone;

(i) a chimney vent conduit attached to, and in communication with, a portion of said inlet duct which does not overlap said gas extension tube, said chimney vent conduit extending downwardly through said second opening of said stripper cap;

(j) a conical baffle adjacent and axially aligned with a bottom opening of said chimney vent conduit, and having a greater diameter than does said bottom opening;

(k) means for sealing said riser and primary cyclone diplegs, said primary cyclone dipleg passing through said third opening in said stripper cap; and (l) a catalyst discharge conduit attached to a lower portion of said means for stripping for discharging catalyst to outside of said reactor vessel.

* * * * *